United States Patent [19]

Noisier

[11] 4,390,480

[45] Jun. 28, 1983

[54] CARBURETTORS WITH ACCELERATION PUMP

[75] Inventor: Guy Noisier, Brunoy, France

[73] Assignee: Societe Industrielle de Brevets et D'Etudes (SIBE), Neuilly sur Seine, France

[21] Appl. No.: 269,616

[22] Filed: Jun. 2, 1981

[30] Foreign Application Priority Data

Jun. 19, 1980 [FR] France ..... 80 13624

[51] Int. Cl.[3] ..... F02M 7/08

[52] U.S. Cl. ..... 261/34 A; 261/34 B

[58] Field of Search ..... 261/34 A, 34 B

[56] References Cited

U.S. PATENT DOCUMENTS

| | | | |
|---|---|---|---|
| 1,948,999 | 2/1934 | Westcott | 261/34 A |
| 2,156,390 | 5/1939 | Henning | 261/34 A |
| 2,209,401 | 7/1940 | Jennings, Jr. | 261/34 A |
| 2,230,311 | 2/1941 | Seymour | 261/34 A |
| 2,252,960 | 8/1941 | Brown | 261/41 D |
| 3,210,054 | 10/1965 | Gettell | 261/34 A |
| 4,272,459 | 6/1981 | Berger | 261/34 A |

FOREIGN PATENT DOCUMENTS

| | | | |
|---|---|---|---|
| 2820203 | 11/1978 | Fed. Rep. of Germany | 261/34 B |
| 2327413 | 10/1975 | France . | |
| 52-52044 | 4/1977 | Japan | 261/34 A |
| 497674 | 12/1938 | United Kingdom | 261/34 A |
| 610046 | 10/1948 | United Kingdom | 261/34 A |

*Primary Examiner*—Tim R. Miles

*Attorney, Agent, or Firm*—Larson & Taylor

[57] ABSTRACT

A carburettor has an acceleration pump whose movable wall is mechanically actuated by the throttle valve. The acceleration pump is disabled as long as the engine is at rest. For instance, the movable wall may be separated from the throttle valve or locked in a rest position.

2 Claims, 5 Drawing Figures

Fig. 1.
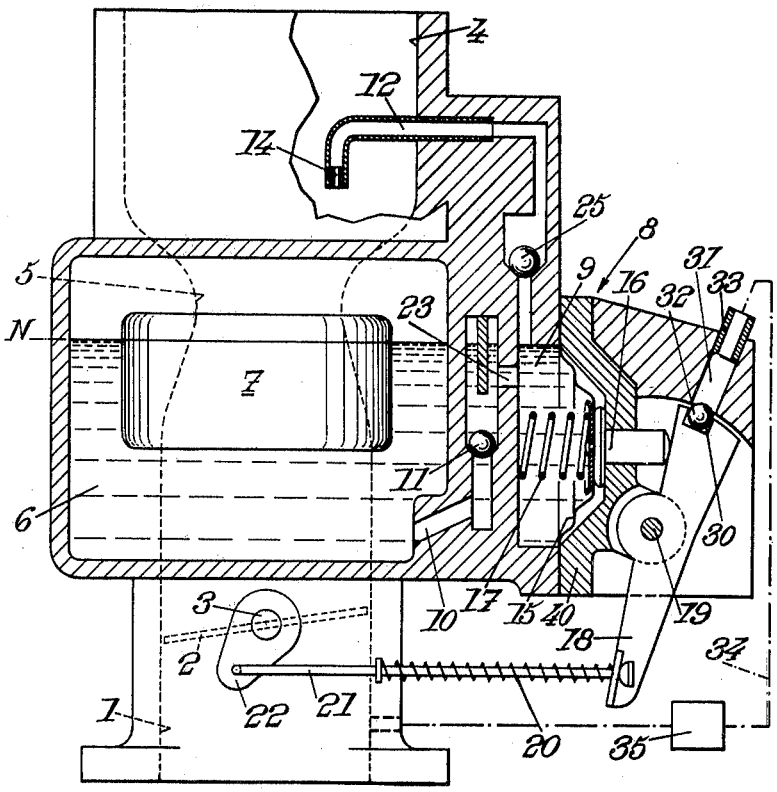
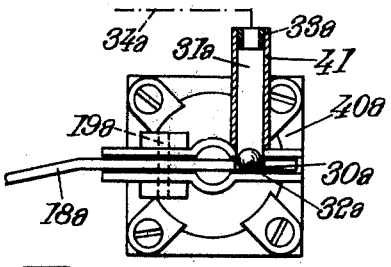
Fig. 2.
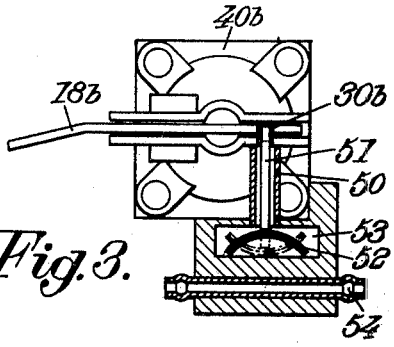
Fig. 3.

CARBURETTORS WITH ACCELERATION PUMP

BACKGROUND AND SUMMARY OF THE INVENTION

The present invention relates to carburettors for internal combustion engines of the type comprising an acceleration pump whose variable-volume chamber is connected to a float chamber through an inlet passage and to the part of the induction passage of the carburettor situated upstream of an operator actuatable throttle member by a delivery passage with a delivery check valve, said variable volume chamber being defined by a movable wall mechanically connected to the throttle member and arranged for reducing the volume of the chamber upon opening movement of said throttle member.

The acceleration pump is for delivering liquid fuel to the induction passage during acceleration, i.e. during opening of the throttle member of the carburettor. But any action on the accelerator pedal causes delivery of fuel to the engine. While that delivery is useful when the engine is operating and must be accelerated, the fuel is not only wastefully consumed but further tends to "drown" the engine through an excess of richness if the throttle member is opened while the engine is stopped. This drawback is particularly noticeable on starting up an engine which is still hot: if the driver depresses the accelerator pedal several times in succession, the engine is drowned and can only be started up again after several minutes.

It is an object of the invention to provide a carburettor with an acceleration pump which is improved particularly in that the action of the acceleration pump is suppressed when not necessary.

According to the invention, a carburettor of the above-defined type has an acceleration pump which is disabled as long as the engine is stopped.

In a preferred embodiment, a connecting linkage between the throttle member and the movable wall of the acceleration pump is associated with a locking device which renders the pump inactive when the engine is at rest and which is subjected to the depression which prevails in the induction passage so as to allow the pump to operate when the depression is at a level indicating that the engine is running. The locking device may typically comprise a ball guided in a passage formed in the body of the carburettor, movable between a rest position in which it projects outside the body into a cavity or notch provided in a lever which actuates the pump so as to secure said lever against movement and a disabled position into which it is brought by said depression. The device may additionally include a manually or thermostatically controlled valve prohibiting, when closed, application of the depression to the locking device.

In another embodiment of the invention, the locking device may be arranged to prevent operation of the acceleration pump when the engine is stopped and to limit the amount of fuel fed by the acceleration pump to the engine during acceleration to a value which depends on the amount of depression in the induction passage.

According to yet another embodiment of the invention, operation of the pump when the engine is stopped is avoided by disabling the mechanical linkage from the throttle member when the engine is stopped.

The invention will be better understood from the following description of particular embodiments, given by way of examples. The description refers to the accompanying drawings.

SHORT DESCRIPTION OF THE DRAWINGS

FIG. 1 is a schematic vertical cross-section of the parts concerned by the invention of a carburettor according to a first embodiment, the parts being shown in the position which they assume when the engine is at a stop;

FIG. 2 is a detail view of another embodiment of the invention, the parts being again shown in the position they assume when the engine is stopped;

Figure 4:
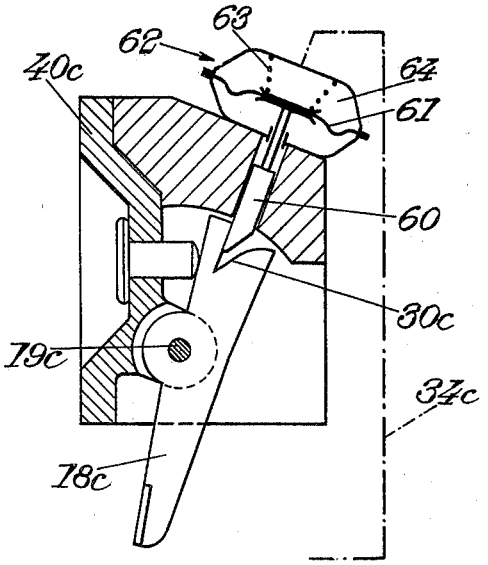
Figure 5:
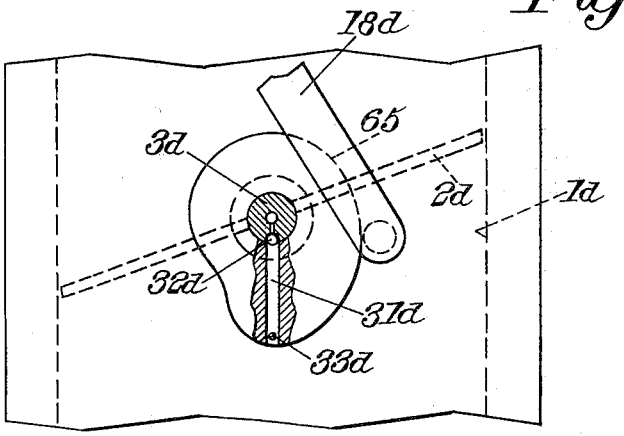

FIG. 3 illustrates a device for locking the pump lever in a particular temperature range of the engine which may be embodied in the carburettor, the parts being shown in the position they assume when the engine has reached its normal temperature of operation; and FIGS. 4 and 5 are detail views showing further embodiments of the invention, the essential parts being shown in the position they assume when the engine is idling.

DETAILED DESCRIPTION OF A PARTICULAR EMBODIMENT

Referring to FIG. 1, there is shown a carburettor which comprises a body made from several assembled parts, in which there is provided an intake duct or induction passage 1. This intake duct is provided with a throttle member controlled by the driver, formed by a butterfly valve 2 fixed on a shaft 3, an air intake 4 protected by a filter (not shown) and a venturi 5 into which emerges a fuel jet system (not shown).

The carburettor further comprises subsidiary circuits, in particular an idling circuit and a starting system, which have not been shown for they are not necessary for an understanding of the invention.

The carburettor comprises a float chamber 6 with constant level N for supplying fuel. The fuel coming from a fuel tank (not shown) is admitted into this chamber 6 by a needle valve (not shown) actuated by a float 7.

The carburettor is provided with an acceleration pump 8. This pump comprises a variable-volume chamber 9 defined by a fixed wall and a mobile wall, deformable here. The fixed wall is advantageously formed by the wall of chamber 6 itself, as shown in FIG. 1. The mobile wall, which enables the volume of the chamber to be reduced during the opening movement of throttle member 2, is formed by a flexible diaphragm 15 to which is fixed a pushrod 16. The pushrod 16 passes, in a guide-hole, through the cover 40 of the pump, fixed to the rest of the body by means not shown. Pushrod 16 is provided so as to be actuated by throttle member 2 through a control linkage, and not by a pneumatic element responsive to the depression variations in the intake pipe, a solution which has been abandoned to all intents and purposes at the present time because of its drawbacks. The linkage comprises a lever 18 which rotates about a pin 19 mounted to the cover 40 and a rod 21 pivoting on a lever 20 integral with the shaft 3 of the throttle member. The movements of lever 22 during opening of the throttle member 2 are transmitted to lever 18 through a progressive-pressure spring 20 which limits the forces which may be transmitted by rod 21, more especially so as to avoid possible damage following excessive forces. It can be seen that the opening of the throttle member tends to rotate lever 18 in an anticlockwise direction. The lever tends to urge pushrod 18 against the action of a return spring 17.

The variable-volume chamber 9 is connected to chamber 6 by a suction passage 10 having a suction valve 11 and by a passage 23. It is connected to the intake duct 1 by a delivery conduit 12 having a calibrated injection port 14 and delivery valve 25.

The carburettor which has been described up to now is similar to the one which forms the subject of French Patent Application No. 2,327,413 to which reference may be made for a full description of the operation thereof. But the carburettor of FIG. 1 further comprises means prohibiting operation of the pump when the engine is stopped.

In the embodiment shown in FIG. 1, the means are formed by a device for locking lever 18 when the engine is stopped. This device comprises a notch 30 formed at the upper part of lever 18 and a ball 32 movable in a passage 31 provided in a bulge of the cover of the pump. This passage is very much inclined with respect to the horizontal so that ball 32 tends to escape downwards out of passage 31. The passage and the notch are placed so that, when lever 18 is at rest, the ball engages notch 30 and secures the lever against movement.

Passage 31 is connected to the part of the intake duct 1 situated downstream of throttle member 2 by means of an end-piece 33 fitting into passage 31 and a conduit 34. In the embodiment illustrated in FIG. 1, a valve 35 is placed in conduit 34. This valve may be more particularly an electromagnetic valve normally open but associated with a control knob under the control of the driver. This valve may also be controlled by a thermostatic member so as to close when the engine reaches a temperature above which the acceleration pump is no longer required for proper operation of the engine when accelerating. In both cases, when the valve is closed, the atmospheric pressure is permanently established in passage 31 through leaks or through a calibrated orifice (not shown). The ball remains then in the lower position and secures lever 18 against movement. The presence of this valve is obviously not indispensable.

The operation of the carburettor is then as follows:

When the engine is stopped, the different parts are in the positions shown in FIG. 1. No depression is transmitted by conduit 34 to passage 31. The butterfly valve is closed, notch 30 is placed facing the passage. Ball 32 projects into notch 30 and secures the lever against movement. The thickness of the slot provided in the projection of cover 40 for passing lever 18 therethrough must obviously be sufficiently small so that ball 32 cannot escape laterally.

If, under these circumstances, the driver depresses the accelerator pedal, butterfly valve 2 opens but does not actuate lever 18 which is locked. Only spring 20 is compressed. The acceleration pump 8 is therefore not actuated and does not feed fuel to the engine which cannot be drowned.

As soon as the engine is self-running, the depression which appears downstream of throttle member 2 is transmitted by conduit 34 to passage 31, that is to say if valve 35 is absent or open. The depression which prevails during idling is generally sufficient to overcome the weight of the ball and to urge it against end-piece 33, provided that the diameter of the ball is only very slightly less than that of passage 31. From this moment, lever 18 is unlocked and may pivot freely. The upper edge of the lever must obviously be sufficiently long so that the ball cannot escape and fall when the lever is at the end of its delivery travel.

On the other hand, if valve 35 is closed, lever 18 is again locked as soon as its notch 30 is again facing channel 31.

A valve 35 will be advantageously used whose closure member is controlled by a thermostatic element or formed by a thermostatic element responsive to the temperature of the engine, when the action of the acceleration pump may be discontinued above a predetermined temperature. The thermostatic element may in particular be formed by a blistered bimetallic strip whose concavity is reversed at a given temperature. This element may be placed in a case subjected to the action of the cooling water for the engine.

A manually controlled valve 35 may also be used so as to allow the driver to neutralize the acceleration pump when he desires maximum fuel economy, at the price of a slightly reduced performance of the engine.

The means for disabling the pump shown in FIG. 1 are particularly adapted to a carburettor whose acceleration pump lever rotates about a horizontal axis. If, on the other hand, the lever rotates about a vertical axis, the arrangement shown in FIG. 2 may be used, where the parts corresponding to those in FIG. 1 are designated by the same reference number to which the index a has been added. In FIG. 2, lever **18*a* pivots about a vertical pin 19*a* mounted to the pump cover 40*a*. In lever 18*a*, there is formed a hole 30*a* which coincides with a vertical passage 31*a* defined by a tube 41 when lever 18*a* is at rest. Tube 41, fixed to the pump cover, contains a ball 32*a* whose diameter is very slightly less than that of passage 31*a* so as to be able to move freely between an upper position in which it abuts against an end-piece 33*a* and a lower position in which it bears on the lever and engages in the hole thereof when the lever is at rest. End-piece 33*a* is connected by a conduit 34*a*** to the part of the intake duct situated downstream of the throttle member.

Since operation is very similar to that of the device shown in FIG. 1, it is not necessary to describe it again.

The ball locking device which has just been described presents the advantage of being extremely simple and of low cost. It will be advantageously used when all-or-nothing operation is desired. However, a locking rod could also be used controlled by a pneumatic diaphragm motor or by an electromagnet which is only energized when the engine is running.

The device for disabling the pump as long as the engine is stopped may be completed by a device which also disables it when the temperature of the engine is greater than a predetermined value.

Such a complementary device is shown in FIG. 3, where the parts corresponding to those already described are designated by the same reference number to which the index b has been added. The device for locking lever **18*b* above a predetermined temperature comprises a metal rod 51 which slides in a tube 50 fast with cover 40. A hole 30*b* pierced in lever 18*b* coincides with tube 50 when the lever is at rest. Rod 51 is movable by means of a temperature-sensitive bimetallic element 52 between a retracted position in which it penetrates into tube 50, and a projecting position in which it projects into hole 30*b* which may moreover be elongated. The bimetallic element 52 is placed in a housing 53 subjected to the temperature of the cooling water of the engine flowing in a duct 54. It pushes back rod 51 to the locking position shown in FIG. 3** when the temperature is greater than said predetermined value.

The means for disabling the pump shown in FIGS. 1 to 3 operate by locking lever 18. These means could also operate in a different way, for example by uncoupling lever 18 from lever 22 when the engine is stopped, for example under the action of a pneumatic control element.

The means for disabling the pump may, when they allow operation thereof, limit the volume of fuel delivered to a value depending on the level of depression. FIG. 4 shows, by way of example, such means. The locking device comprises, instead of a ball, a bevelled edge part 60 carried by the mobile wall 61 of a pneumatic element 62. This mobile wall 61 is subjected to the opposite actions of a return spring 63, which pushes the bevelled edge part 60 to a position where it secures lever 18*c* against movement, and of the depression in a chamber 64 connected by a conduit 34*c* to the portion of the intake duct 1 situated downstream of the throttle member. Notch 30*c* in lever 18*c* may have a form such that the lever is secured against any movement when the bevelled edge part 60 is completely engaged in the notch, but may move angularly through an angle until it is completely free when the depression in chamber 64 corresponds to the maximum depression likely to be created by the engine.

As was mentioned above, the means for disabling the acceleration pump may be provided for disengaging the latter from the throttle member. They have this function in the embodiment shown in FIG. 5, where the parts corresponding to those already described bear the same reference number to which the index d has been added. Lever 18*d* is controlled by a cam 65 carried by the shaft 3*d* of throttle member 2*d*. In cam 65, there is provided a passage 31*d* extending downwards from the shaft. In this passage, there is placed a ball 32*d* retained by a stop 33*d*. In shaft 3*d*, there is provided a notch connected, by a central passage of the shaft and a passage not shown, to the part of the intake duct 1*d* situated downstream of the throttle member.

When the engine is stopped, the weight of the ball holds it against stop 33*d*: the cam is then disengaged from shaft 3*d*.

On the contrary, when the engine is operating, it causes a depression to appear in the notch. When this latter is opposite passage 31*d*, the depression sucks up the ball 32*d* which engages in the notch, whose depth is such that the ball 32*d* interlocks the cam and the shaft.

The invention is susceptible of numerous embodiments other than those which have been shown and described by way of example and it should be understood that the scope of the present patent extends to any variation remaining within the scope of the claim.

I claim:

1. A carburettor for an internal combustion engine having an acceleration pump whose variable volume chamber is connected to a float chamber through an inlet passage and to the part of the induction passage of the carburettor situated upstream of an operator operable throttle member through a delivery passage having a delivery check valve, said variable volume chamber being defined by a movable wall mechanically connected to said throttle member by a mechanical linkage and arranged to actuate said movable wall to reduce the volume of the chamber in response to opening movement of said throttle member, wherein a locking device is provided for disabling the acceleration pump as long as the engine is stopped and comprises a ball guided in a passage provided in the body of the carburettor, movable between a rest position in which it projects outside the body into a cavity provided in a lever of said mechanical linkage controlling the pump so as to secure said lever against movement and a disengaged position into which it is brought by said depression.

2. A carburettor as claimed in claim 1, wherein said locking device further comprises a manually or thermostatically controlled valve preventing, when closed, application of the depression to the locking device.

* * * * *